US008127698B1

(12) United States Patent
Ingram

(10) Patent No.: US 8,127,698 B1
(45) Date of Patent: Mar. 6, 2012

(54) YARN TENSIONING MECHANISM

(75) Inventor: Gary L. Ingram, Ooltewah, TN (US)

(73) Assignee: Tuftco Corporation, Chattanooga, TN (US)

( * ) Notice: Subject to any disclaimer, the term of this patent is extended or adjusted under 35 U.S.C. 154(b) by 434 days.

(21) Appl. No.: 12/507,062

(22) Filed: Jul. 21, 2009

Related U.S. Application Data

(60) Provisional application No. 61/082,311, filed on Jul. 21, 2008.

(51) Int. Cl.
*D05C 15/18* (2006.01)
*D05B 47/00* (2006.01)

(52) U.S. Cl. ..... 112/80.7

(58) Field of Classification Search ..... 112/80.7–80.73, 112/254, 255, 302; 57/58.83; 242/410, 426.08, 242/422; 139/452, 450
See application file for complete search history.

(56) References Cited

U.S. PATENT DOCUMENTS

| | | | | | |
|---|---|---|---|---|---|
| 3,160,125 | A * | 12/1964 | Payne et al. | ..... | 112/80.24 |
| 3,375,797 | A * | 4/1968 | Gaines | ..... | 112/80.24 |
| 5,182,997 | A * | 2/1993 | Bardsley | ..... | 112/80.73 |
| 5,345,887 | A * | 9/1994 | Droste | ..... | 112/255 |
| 6,202,580 | B1 * | 3/2001 | Samilo | ..... | 112/80.73 |
| 6,935,257 | B2 * | 8/2005 | Griffith | ..... | 112/80.73 |
| 2005/0132944 | A1 * | 6/2005 | Hayashi et al. | ..... | 112/80.7 |

* cited by examiner

*Primary Examiner* — Ismael Izaguirre
(74) *Attorney, Agent, or Firm* — Miller & Martin PLLC

(57) ABSTRACT

A yarn tensioning apparatus is supplied with a yarn clamping position and a positive yarn engaging position to precisely meter yarns to tufting machine needles and especially to more uniformly advance pneumatically supplied yarns to hollow needles.

20 Claims, 5 Drawing Sheets

Gear Housing Engaged
Against Driven Puller Roll

Gear Housing w/ One Side Plate Removed

Gear Housing Assembled

Gear Housing Engaged
Against Driven Puller Roll

Gear Housing Disengaged
From Driven Puller Roll

SECTION B-B

YARN TENSIONING MECHANISM

The present application claims priority to the Jul. 21, 2008 filing date of U.S. provisional patent application Ser. No. 61/082,311.

FIELD OF THE INVENTION

The present invention is addressed to more precisely feeding yarns for sewing fabrics, and is especially adapted to the feeding of yarns that are pneumatically supplied for tufting, as via a hollow needle.

BACKGROUND OF THE INVENTION

In most hollow needle tufting machines, as typified by Kile, U.S. Pat. No. 4,549,496; Davis, et al., U.S. Pat. No. 5,588,383 and Ingram, U.S. Pat. No. 7,318,383, yarns are selectively fed to hollow needles by pneumatic pressure. Where the yarn being fed to a particular needle is changed, Kile and Davis found it necessary to retract the previously fed yarn from the hollow needle and to pneumatically urge the newly selected yarn to extend through the hollow needle to the appropriate length for tufting. Due to the characteristics of yarns and the imprecise nature of pneumatically supplied yarn, the lengths of yarns tufted are generally not uniform and the resulting fabrics not only require tip shearing but also result in the waste of substantial amounts of yarn.

Accordingly, the need exists to obtain more uniform stitch height with pneumatically fed yarns. Due to the elasticity of yarns, when tension is released from a yarn being fed for tufting, there is a contraction of yarn length. Different yarns have differing elasticities so the contraction is not precisely controllable. Furthermore, the amount of contraction varies with the length of yarn that has been placed under tension. Therefore, a need exists to provide for the provide for the feeding of yarns, and particularly the pneumatic feeding of yarns, in a fashion where only a relatively short length of yarn is placed under tension when the yarn is fed. In this fashion, the contraction of the yarn will be limited when the tension is released.

Additionally, even in the case of yarns fed by conventional means, varying yarn elasticity contributes to less uniform output. For instance, varying tension in pulling yarns from a yarn supply, and the release of tension after yarns are cut or otherwise released from a hook or looper, may cause different yarns to produce yarn bights of different heights.

Furthermore, some pneumatic yarn feeds are designed to constantly urge yarns to their associated hollow needles. In the absence of a tensioning device, the yarns will be fed at an incremental rate toward the hollow needle. Therefore, a need exists to prevent the slippage of yarns that are not selected for the current stitch.

SUMMARY OF THE INVENTION

In order to accomplish these and other objects of the invention, an improved yarn feed control is provided with the teethed yarn puller wheels to positively grip and feed yarns. A yarn tensioning and clamping device is also provided that serves to keep yarns under tension while those yarns are being fed for tufting and that clamps the yarns when yarn feed tension is relaxed so that only a limited length of yarn may contract, and so that there is no slippage of yarns that are not selected for tufting.

BRIEF DESCRIPTION OF THE DRAWINGS

The particular features and advantages of the invention as well as other objects will become apparent from the following description taken in connection with the accompanying drawings in which.

DETAILED DESCRIPTION OF THE INVENTION

Figure 2:
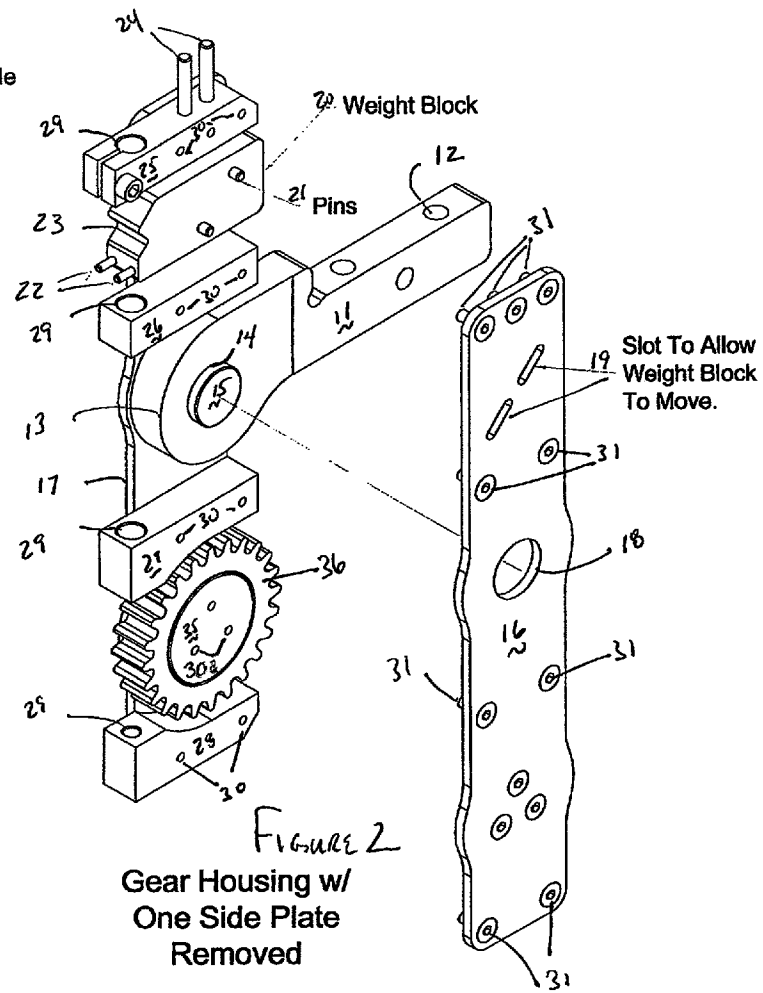
FIG. 2 is a partially exploded perspective view of the gear housing assembly of FIG. 1.
Figure 1:
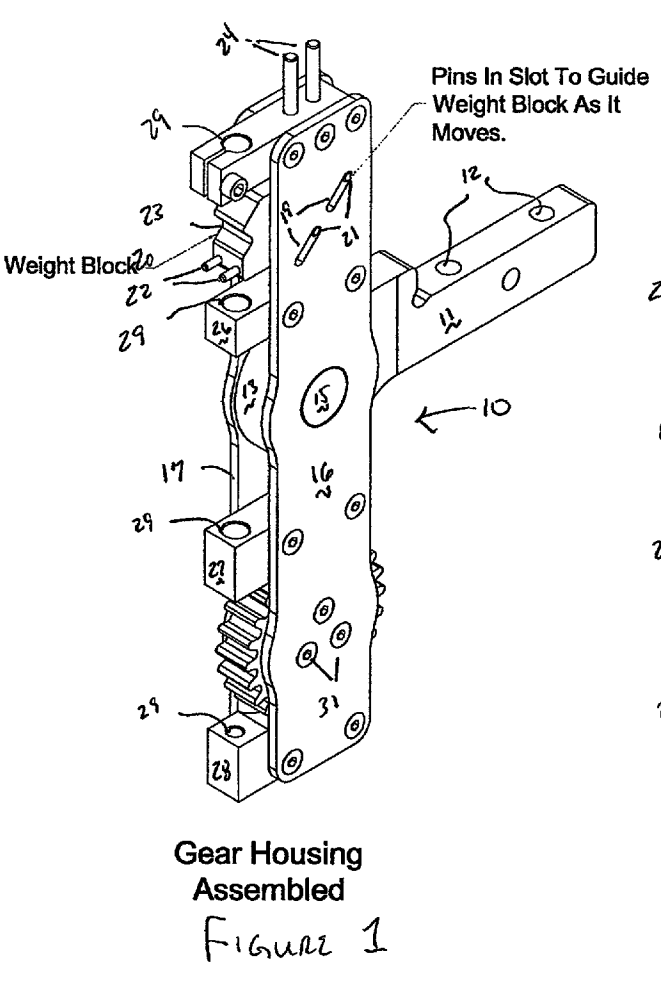
FIG. 1 is a perspective view of a gear housing assembly with yarn clamping and yarn feed control components.

In FIGS. 1 and 2 a gear housing assembly 10 designed to provide precise yarn feed and yarn tensioning control is illustrated. The principal elements of gear housing assembly 10 are coupling pins 24, weight block 20, mounting bar 11, and teethed yarn roll 36. These elements are carried in a structure comprising first side plate 16 and second side plate 17 with fasteners 31 that are received in fastener openings 30 located in top fastening block 25, second fastening block 26, third fastening block 27, and bottom fastening block 28. In addition, some fasteners 31 are received within openings 30*a* in bearing support 35.

Figure 3:
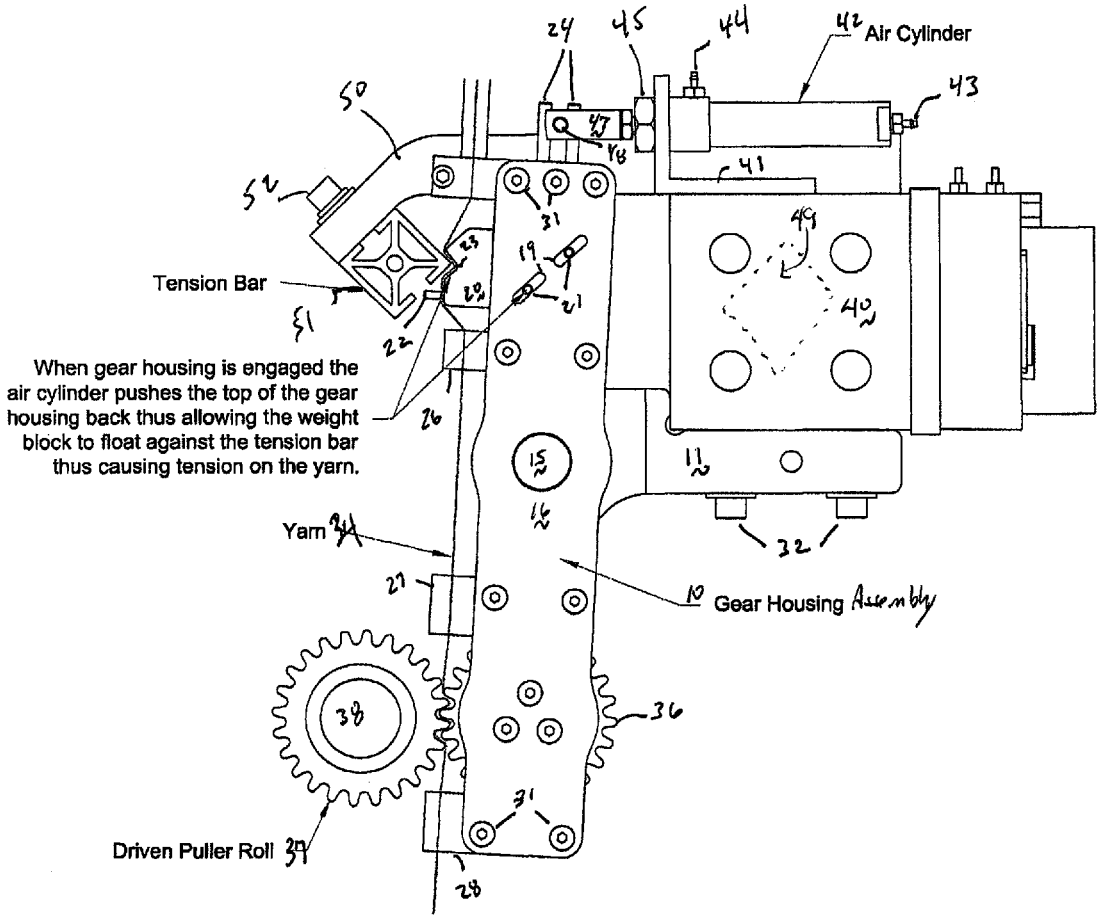
FIG. 3 is a side plan view of the gear housing assembly of FIG. 1 mounted to the head of a tufting machine and engaged with a driven yarn feed roll.
Figure 4:
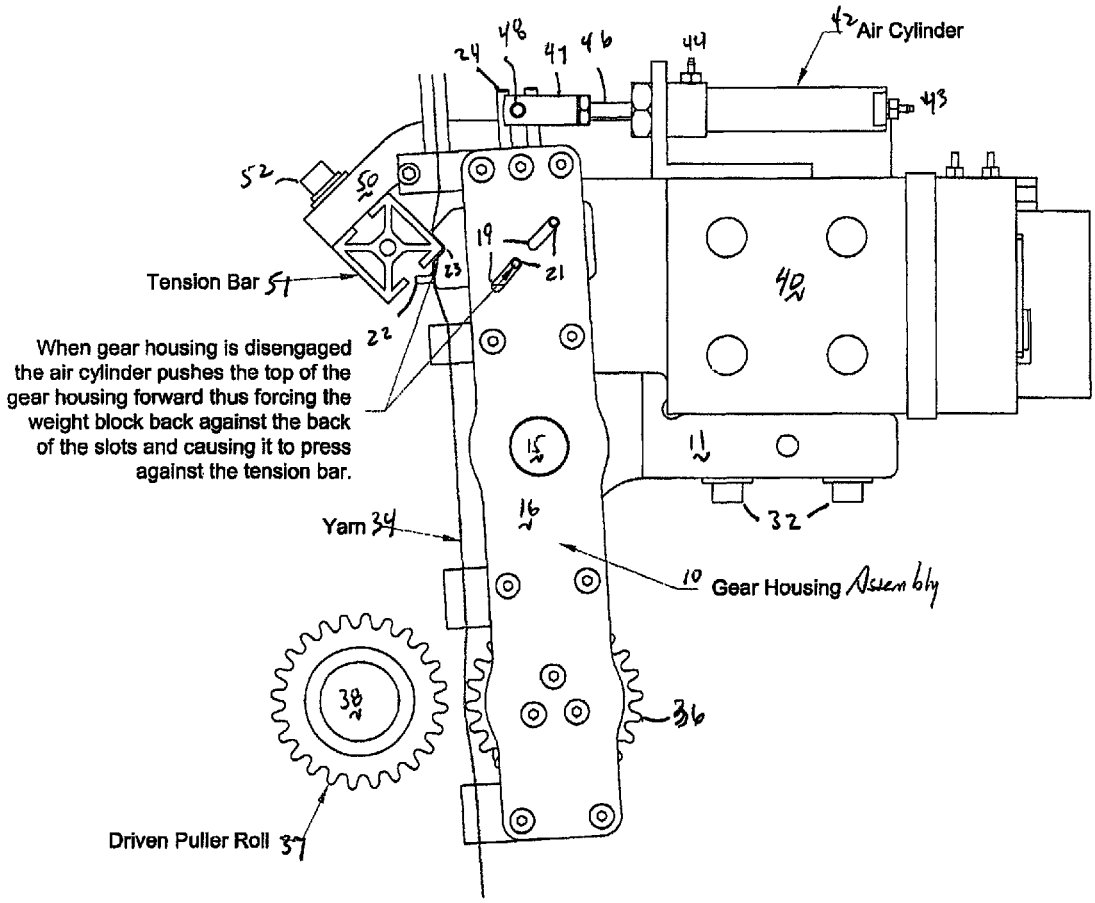
FIG. 4 is a side plan view of the gear housing assembly of FIG. 1 mounted to the head of a tufting machine in a position clamping a yarn against a tension bar.
Figure 5:
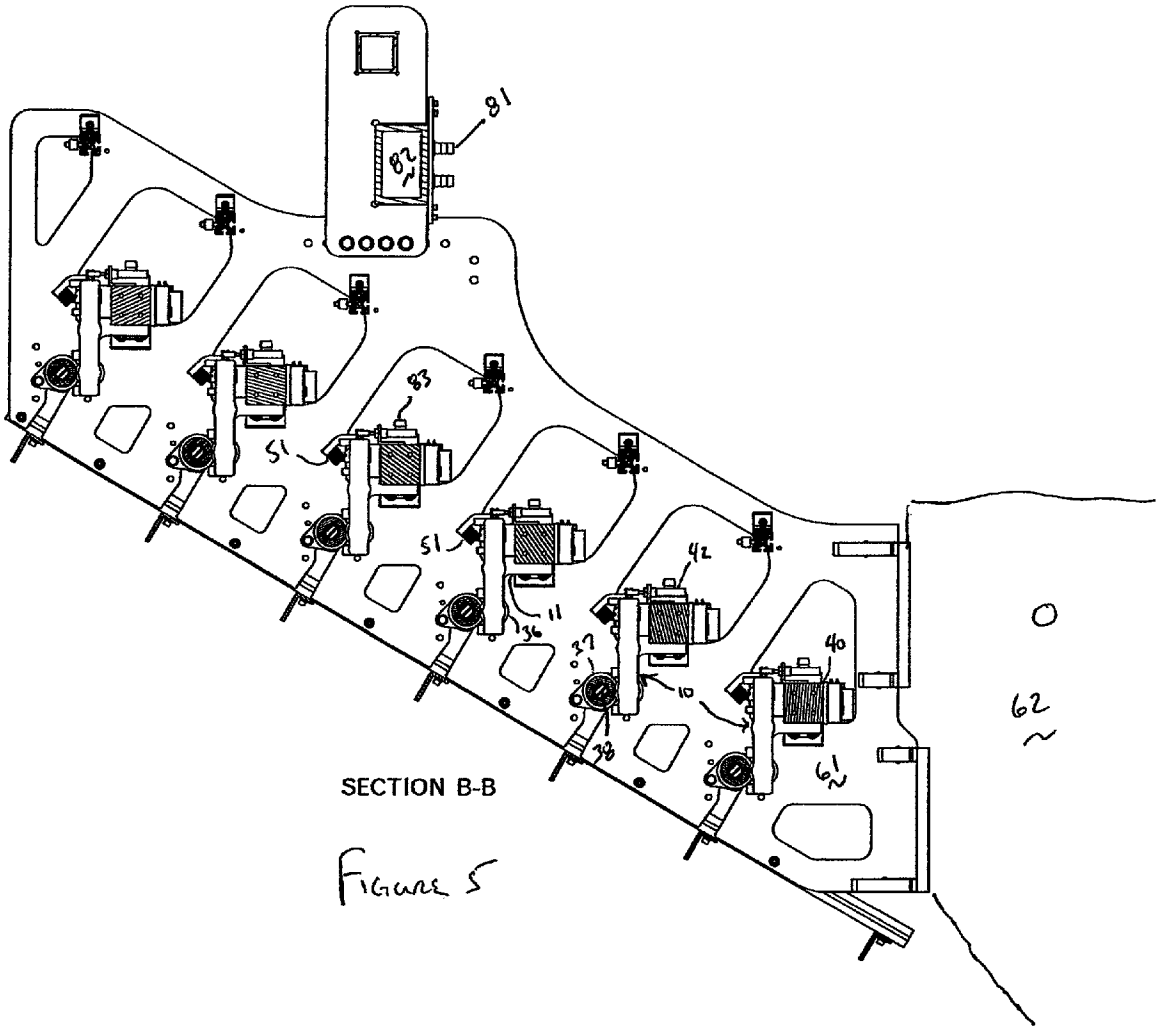
FIG. 5 is a side sectional view of an array of gear housing assemblies attached to a tufting machine head.
Figure 6:
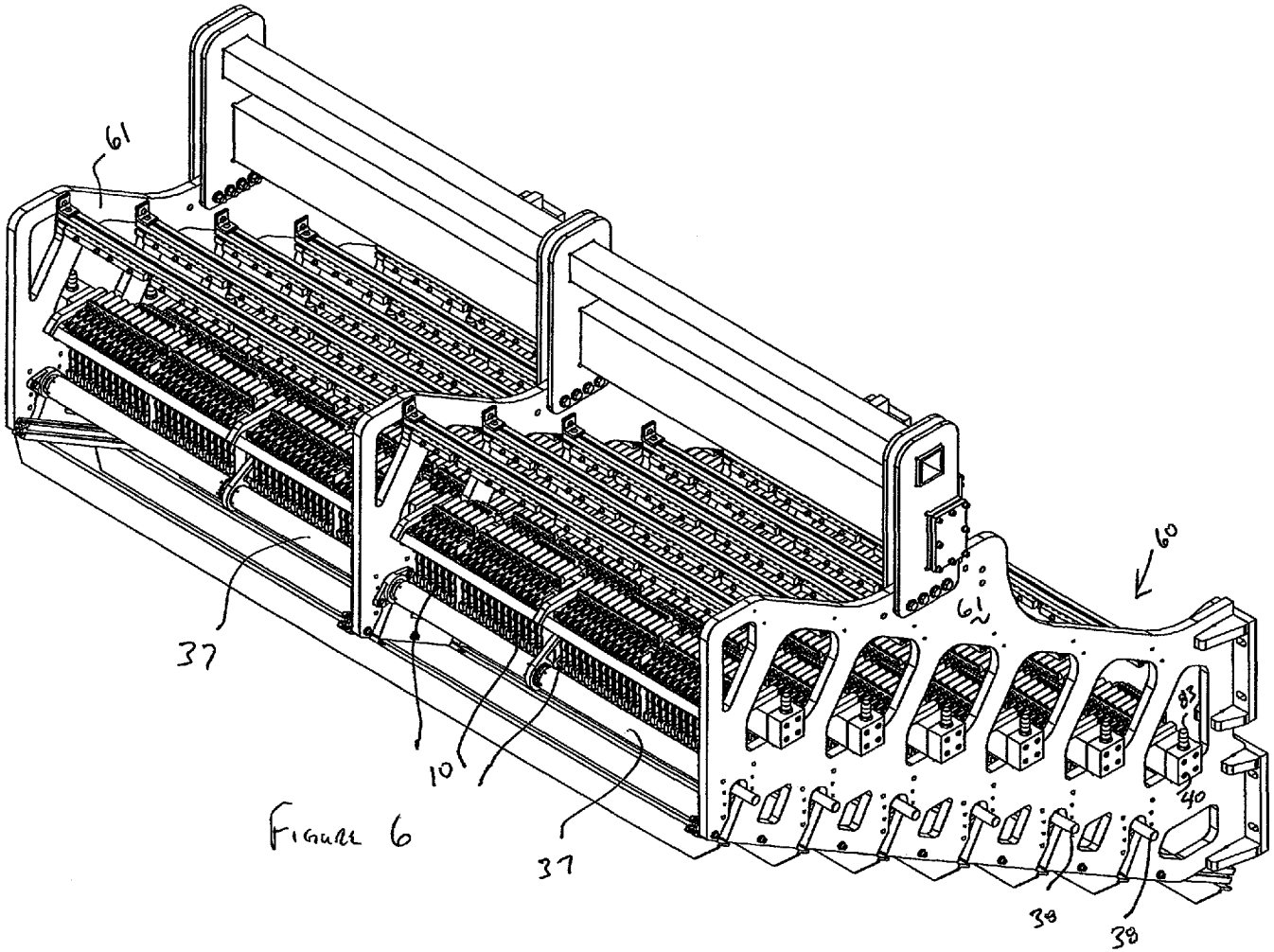
FIG. 6 is a perspective view of a pattern control yarn feed system comprising an array of gear housing assemblies and driven yarn feed rolls.

Turning then to the principal features of the gear housing assembly 10, the coupling pins 24 extend upwards and operate in conjunction with a clevis 47 and clevis pin 48 illustrated in FIGS. 3 and 4 to apply pressure at the top of the gear housing assembly on coupling pins 24. Mounting bar 11 has vertical openings 12 which, as shown on FIGS. 3 and 4, receive fasteners 32 to mount the gear housing assembly 10 on the manifold beam 40 which, as shown in FIGS. 5 and 6, is in turn mounted in a frame 61 of pattern control yarn feed attachment 60 that is mounted to the head 62 of a tufting machine. At the end of the mounting bar 11 opposite the vertical openings 12 is a rounded end 13 and a lateral opening 14 that receives bearing pin 15 extending between the first side plate 16 and second side plate 17 and being received in plate opening 18 on the first side plate 16 and a similar opening in second side plate 17 as shown in FIGS. 1 and 2. The rounded end 13 permits the structure held by the first side plate 16 and second side plate 17 to rotate about 10 degrees in either direction. The slots 19 in cooperation with the lateral pins 21 permit the weight block 20 to move slightly forward and rearward relative to the first side plate 16 and second side plate 17. The weight block 20 has at one end a yarn clamping area such as notch 23. The gear housing assembly 10 also has a series of yarn guiding features such as apertures 29 in fastening blocks 25, 26, 27, 28 and yarn guide pins 22 on weight block 20.

In FIG. 3, the gear housing assembly 10 is illustrated in operation to provide precise increments of yarn to associated needles. On support manifold 40 at the bottom is secured the mounting bar 11 of gear housing assembly 10. Within the manifold are pressurized air conduits 49 that convey pressurized air to electronically controlled valves, not shown, that selectively supply air pressure to ports 43, 44 of air cylinder 42. On the top of support manifold 40 is L bracket 41 which has an opening to receive the forward end of cylinder 42. The forward end of cylinder 42 is threaded and fastened in place by securing bolt 45 on the opposite face of L bracket 41. Air cylinder 42 is preferably a double acting cylinder with air supplied to port 44 to retract the cylinder shaft 46, shown in FIG. 4. Conversely, pressurized air is supplied to port 43 to drive the cylinder shaft 46 forward.

In FIG. 3, the gear housing assembly 10 is shown with pressurized air having been supplied to port 44 so that cylinder shaft 46 is entirely retracted and clevis 47 is in proximity to cylinder mounting bolt 45. Clevis pin 48 is positioned between coupling pins 24 and has moved the top portion of gear housing assembly 10 closer to the tufting machine head 62 while the bottom portion of gear housing assembly 10 carrying yarn roll 36 has pivoted about bearing pin 15 to extend outward and engage its teeth with the teeth of driven yarn roll 37 mounted on drive shaft 38. The yarn 34 being fed from yarn supply, not shown, through vertical yarn guide openings 29 in fastening blocks 25, 26, 27 and 28 is carried between the interfitting teeth of yarn roll 36 and driven yarn roll 37 and securely gripped. In this fashion, a precise increment of yarn is advanced by the rotation of drive shaft 38 and corresponding driven yarn roll 37.

It will also be seen that a stationary clamping member such as tension bar 51 is mounted with fastener 52 to angle 50 that connects back to support beam 40. When the upper portion of gear housing assembly 10 is retracted toward the tufting machine head 62 as illustrated in FIG. 3, the lateral pins 21 of weight block 20 are positioned in intermediate portions of slots 19 so that the yarn 34 passing through notch 23 is tensioned only by the weight of block 20. This allows the yarn to advance, when pulled by driven yarn roll 37 but the yarn advances in a tensioned state so that the longitudinal elasticity of the yarn is slightly expanded. Furthermore, in the course of feeding yarn from the yarn supply, there are occasional variations in tension as when yarn unwinding from a spool snags and then releases suddenly. The sudden release of tension sends a wave of excess yarn from the yarn supply to the pattern control yarn mechanism. The pressure provided by weight block 20 is sufficient to prevent the excess yarn 34 from feeding prematurely toward the needles.

In FIG. 4, pressurized air is supplied to port 43 of double acting air cylinder 42 so that cylinder shaft 46 is extended and the top portion of gear housing assembly 10 is moved away from the tufting machine head. The lower portion of gear housing assembly 10 carrying yarn roll 36 is pivoted about bearing pin 15 to move closer to tufting machine and out of engagement with driven yarn roll 37 so that yarn 34 is no longer advanced. However, it can be seen at the upper end of gear housing assembly 10 that the lateral pins 21 of weight block 20 are at the upper most pins of slots 19 in first side plate 16 so that the pressure brought on yarn 34 as it passes through notch 23 is not merely the weight of block 20, but is instead the pressure applied by the action of pressurized gas through port 43 in air cylinder 42. The yarn can thereby be pinched relatively securely between tension bar 51 and the yarn clamping portion of weight block 20, namely in the notch 23 of the illustrated embodiment.

Therefore, in operation, a gear housing assembly 10 is provided for each yarn that is being fed to a needle on the associated tufting machine. In the case of a hollow needle tufting machine, this generally means that six or eight gear housing assemblies are provided for each needle to feed the yarns downward into funnel slots such as are disclosed in Ingram, U.S. Pat. No. 7,318,383. To provide adequate space for this number of gear housing assemblies, yarns may be supplied from both the front and rear side of the tufting machine. In the case of a hollow needle tufting machine with eight yarns supplied to each of the funnel slots, it would typically be advantageous to mount four gear housing assemblies 10 on each side of the tufting machine. When the tufting machine is in operation, only one of the eight gear housing assemblies will be in the yarn advancing position illustrated in FIG. 3 and the remaining seven gear housing assemblies would be in the yarn clamping position illustrated in FIG. 4. When it is desired to switch the yarn being supplied to the associated needle, the gear housing assembly 10 in the yarn supplying configuration of FIG. 3 is operated by the application of air pressure to port 43 of air cylinder 42 to disengage yarn 34 and yarn roll 36 from the driven yarn roll 37 and to simultaneously clamp the yarn 34 between the tension bar 51 and weight block 20. The action of the weight block 20 and the clamping action performs two functions that appear to improve the preciseness of the yarn feed: (1) to prevent the elasticity of the yarn between the yarn supply and the yarn clamping area 23 to substantially alter the length of yarn that has already passed between the position of the yarn rolls; and (2) to prevent the unintended advancement of yarns either by the reciprocating motion of the hollow needle assemblies or by the pneumatic urgings applied to the yarns generally so that they feed freely from the yarn supply to the needles.

When the yarn being supplied to needles is changed, just as the gear housing assembly 10 of the previously supplied yarn is rotated out of the supplying position of FIG. 3, the gear housing assembly 10 of the newly selected yarn is rotated from the clamping position of FIG. 4 to the yarn supplying position of FIG. 3 by the application of pneumatic pressure through port 44 of double acting cylinder 42. The yarn 34 is unclamped and advanced by the positive cooperation of driven yarn roll 37 and yarn roll 36. Due to the clamping action between tension bar 51 and notch 23 of weight block 20, the only length of yarn not already tensioned when the yarn advancement begins is the length of yarn between the yarn clamping point 23 and the mating gear teeth of yarn rolls 36, 37. In this fashion, the operation of gear housing assembly 10 facilitates relatively precise metering of yarns to hollow needles and minimizes height irregularities in the resulting tufted fabrics. This results in less wasted yarn and the ability to produce a finished product with limited tip shearing so that the tufting height of the yarns can be only slightly greater than the intended height of the finished tufted carpets.

Furthermore, the effectiveness of the present yarn control system is such that in the context of a tufting machine with yarns fed by pneumatic pressure to hollow needles, in step of yarn retraction is not required. Instead, the leading end of the yarn after being cut is allowed to remain within the hollow needle. Due to the elasticity of the yarn, there may be a slight retraction of the leading end of yarn from the open tip of the hollow needle after the fed yarn is cut, however, the secure clamping of unfed yarns allows the leading ends of those yarns to remain within the hollow needle without resulting in subsequent underfeeding or overfeeding of the yarns.

In FIGS. 5 and 6, an array of gear housing assemblies 10 are illustrated in a frame 61 optimized to supply six yarns to each hollow needle. The frame 61 is mounted to the head 62 of a tufting machine. A manifold 82 is provided to convey pressurized gas across the width of the tufting machine. The pressurized gas is provided from ports 81 of manifold 82 to ports 83 of the support manifolds 40 and thence through electronically activated valves to air supply ports 43, 44. To complete the array of FIG. 6, preferably independently operable servo motors would be associated with each drive shaft 38 for the driven yarn rolls 37. Both the servo motors and electronically activated air valves are controlled by an electronic controller interpreting pattern data and supplying control commands via electronic signals distributed across an appropriate controller network All publications, patent, and patent documents mentioned herein, and particularly Davis, et al., U.S. Pat. No. 5,588,383 and Ingram, U.S. Pat. No. 7,318,383, are incorporated by reference herein as though individually incorporated by reference. Although preferred embodiments of the present invention have been disclosed in detail herein, it will be understood that various substitutions and modifications may be made to the disclosed embodiment described herein without departing from the scope and spirit of the present invention as recited in the appended claims.

I claim:

1. A yarn tensioning assembly for use in controlling the supply of yarns to the needles of a tufting machine comprising a pivotal yarn tensioning and clamping apparatus and a rotatable yarn gripping wheel operable so that yarn tensioning is provided when the rotatable yarn gripping wheel is pivoted into engagement with a yarn driving wheel, and yarn clamping is provided when the yarn gripping wheel is pivoted out of engagement with a yarn driving wheel.

2. The yarn tensioning assembly of claim 1 wherein the yarn tensioning is provided by yarn passing through a notch against which a slideable weight rests at least some of its weight.

3. The yarn tensioning assembly of claim 1 wherein the yarn clamping is provided by applying clamping pressure upon the yarn passing through the notch between a clamping member and the slideable weight.

4. The yarn tensioning assembly of claim 1 wherein a double acting pneumatic cylinder is used to pivot the assembly into and out of engagement with the yarn driving wheel.

5. The yarn tensioning assembly of claim 1 wherein the yarn passing through the assembly is fed to a hollow needle by continuous pneumatic pressure.

6. A yarn tensioning assembly for use in controlling the supply of yarns to the needles of a tufting machine comprising a housing with a mounting post, wherein said housing has a slideable weight block at a first end and a teethed yarn roll at a second end and a yarn guide for directing yarn through the assembly.

7. The yarn tensioning assembly of claim 6 wherein the housing is pivotal about the mounting post.

8. The yarn tensioning assembly of claim 7 wherein the housing is coupled to an actuator for pivotal movement.

9. The yarn tensioning assembly of claim 8 wherein the actuator is a double action pneumatic cylinder.

10. The yarn tensioning assembly of claim 7 wherein the housing is pivotal to a yarn feeding position where the teethed yarn wheel engages with a driven yarn roll and the yarn is guided between said wheel and roll for feeding yarn to a tufting needle.

11. The yarn tensioning assembly of claim 7 wherein the housing is pivotal to a yarn clamping position where yarn is guided to and clamped in a clamping area between the slideable weight and a clamping member.

12. The yarn tensioning assembly of claim 11 wherein the teethed yarn wheel is not in engagement with a driven yarn roll.

13. The yarn tensioning assembly of claim 10 wherein yarn passing between the slideable weight member and a clamping member is not clamped, but is tensioned by at least some of the weight of the weight block.

14. The yarn tensioning assembly of claim 6 wherein the mounting post is attached to the housing about a bearing pin.

15. The yarn tensioning assembly of claim 14 wherein the bearing pin allows the housing to pivot by about 10 degrees forward and rearward with respect to the mounting post.

16. The yarn tensioning assembly of claim 13 wherein the slideable weight has a notch that partially receives the clamping member to tension the yarn.

17. The yarn tensioning assembly of claim 9 wherein electronically activated valves allow the supply of pressurized gas to an air supply port of the double action cylinder from a manifold.

18. The yarn tensioning assembly of claim 10 wherein the driven yarn roll is driven by a drive shaft in communication with a servo motor.

19. A method of tensioning, clamping and feeding yarns in a hollow needle tufting machine comprising the steps of:

(a) feeding a plurality of yarns to a hollow needle, each through a yarn tensioning assembly having a pivotal yarn tensioning and clamping apparatus and a rotatable yarn gripping wheel operable so that yarn tensioning is provided when the rotatable yarn gripping wheel is pivoted into engagement with a yarn driving wheel, and yarn clamping is provided when the yarn gripping wheel is pivoted out of engagement with a yarn driving wheel;

(b) selecting a first of the plurality of yarns and pivoting the rotatable yarn gripping wheel of the associated yarn tensioning assembly into engagement with the associated yarn driving wheel;

(c) feeding a selected length of the selected first yarn to a hollow needle for tufting; and (d) pivoting the rotatable yarn gripping wheel of the yarn tensioning assembly associated with a second yarn out of engagement with the associated yarn driving wheel and clamping the second yarn so that the second yarn is not fed through the hollow needle.

20. The method of claim 19 comprising the further steps of:

(e) cutting the first yarn so that a bight of yarn is tufted through a backing fabric;

(f) pivoting the rotatable yarn gripping wheel of the yarn tensioning assembly associated with the first yarn out of engagement with the associated yarn driving wheel and clamping the first yarn so that the first yarn is not fed through the hollow needle;

(g) pivoting the rotatable yarn gripping wheel of the yarn tensioning assembly associated with the second yarn into engagement with the associated yarn driving wheel;

(h) feeding a selected length of the second yarn to the hollow needle for tufting without retracting the first yarn.

* * * * *